US005554975A

United States Patent [19]

Hall et al.

[11] Patent Number: 5,554,975

[45] **Date of Patent: * Sep. 10, 1996**

[54] SAFETY DEVICE FOR THE PROPRIOCEPTION IMPAIRED

[76] Inventors: H. Eugene Hall, 10029 NE. 27th St., Bellevue, Wash. 98004; Ray Beddo, 23303 64th Ave. West, Mountlake Terrace, Wash. 98043

[ * ] Notice: The term of this patent shall not extend beyond the expiration date of Pat. No. 5,331,990.

[21] Appl. No.: 216,146

[22] Filed: Mar. 22, 1994

Related U.S. Application Data

[62] Division of Ser. No. 957,245, Oct. 6, 1992, Pat. No. 5,331,990.

[51] Int. Cl.[6] ..... G08B 23/00

[52] U.S. Cl. ..... 340/573; 340/529; 340/539; 340/527; 340/689; 379/38; 135/65

[58] Field of Search ..... 340/573, 529, 340/539, 689, 527, 686, 501; 135/66, 65, 75, 910, 911; 362/102; 379/38

[56] References Cited

U.S. PATENT DOCUMENTS

| | | | |
|---|---|---|---|
| 1,427,138 | 8/1922 | Walicki et al. . | |
| 2,173,624 | 7/1938 | Dyer . | |
| 2,597,172 | 5/1952 | Parker . | |
| 2,642,519 | 6/1949 | Caustin et al. . | |
| 2,908,901 | 10/1959 | Lewis . | |
| 3,158,851 | 11/1964 | Ruthven . | |
| 3,163,856 | 12/1964 | Kirby | 340/573 |
| 3,248,723 | 4/1966 | Miethe | 340/573 |
| 3,336,469 | 8/1967 | Barnes, Sr. et al. . | |
| 3,634,885 | 1/1972 | Barkley | 340/573 |
| 3,802,417 | 4/1974 | Lang | 340/573 |
| 3,877,466 | 4/1975 | Montor | 340/573 |
| 4,044,784 | 8/1977 | Smith . | |
| 4,062,371 | 12/1977 | Bolen . | |
| 4,085,763 | 4/1978 | Thomas . | |
| 4,099,535 | 7/1978 | Hubachek . | |
| 4,236,544 | 12/1980 | Osaka . | |
| 4,524,243 | 6/1985 | Shapiro | 340/573 |
| 4,562,850 | 1/1986 | Earley et al. . | |
| 4,583,080 | 4/1986 | DiVito et al. . | |
| 4,625,742 | 12/1986 | Phillips . | |
| 4,787,405 | 11/1988 | Karowski . | |
| 4,829,285 | 5/1989 | Brand et al. | 340/573 |
| 4,858,622 | 8/1989 | Osterweil | 340/573 |
| 5,008,654 | 4/1991 | Callaway | 340/573 |
| 5,081,447 | 1/1992 | Echols | 340/573 |
| 5,089,808 | 2/1992 | Amirdash | 340/573 |
| 5,097,255 | 3/1992 | Chen | 340/573 |
| 5,146,206 | 9/1992 | Callaway | 340/573 |
| 5,158,089 | 10/1992 | Swezey et al. | 340/573 |
| 5,162,776 | 11/1992 | Bushnell et al. | 340/573 |
| 5,168,264 | 12/1992 | Agustin | 340/573 |
| 5,235,321 | 8/1993 | Rowan et al. | 340/573 |
| 5,235,322 | 8/1993 | Obysovsky et al. | 340/573 |
| 5,266,927 | 11/1993 | Sanders | 340/573 |
| 5,331,990 | 7/1994 | Hall et al. | 340/573 |

FOREIGN PATENT DOCUMENTS

| | | |
|---|---|---|
| 0114929 | 8/1984 | European Pat. Off. . |
| 2418633 | 3/1978 | France . |
| 3811037 | 3/1988 | Germany . |
| 2060370 | 5/1981 | United Kingdom . |

*Primary Examiner*—Brent A. Swarthout
*Assistant Examiner*—Nina Tong
*Attorney, Agent, or Firm*—Richardson & Folise

[57] ABSTRACT

A safety cane incorporates an ambient light sensitive illumination device for conserving battery power. A tipping detector is also incorporated which sounds an audible alarm after a first time delay. If the cane is not retrieved by the end of the second time delay, the cane broadcasts an initiating instruction to a telephone dialing device.

3 Claims, 5 Drawing Sheets

FIG. 2
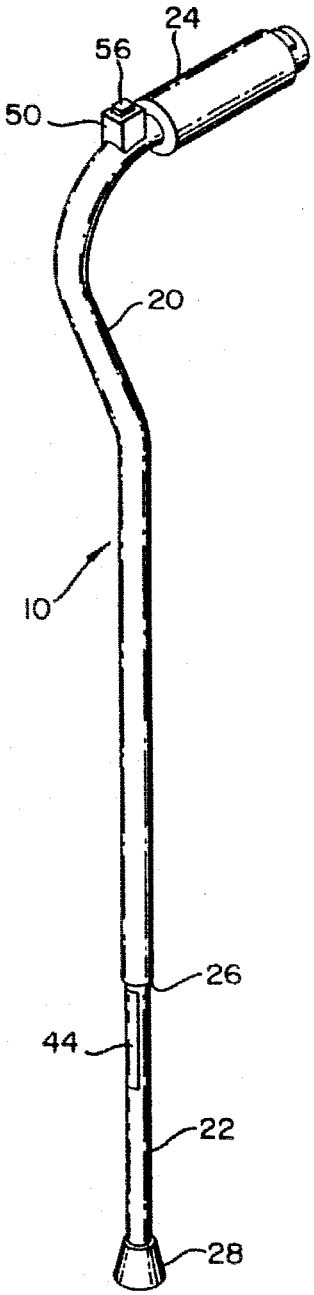
FIG. 3
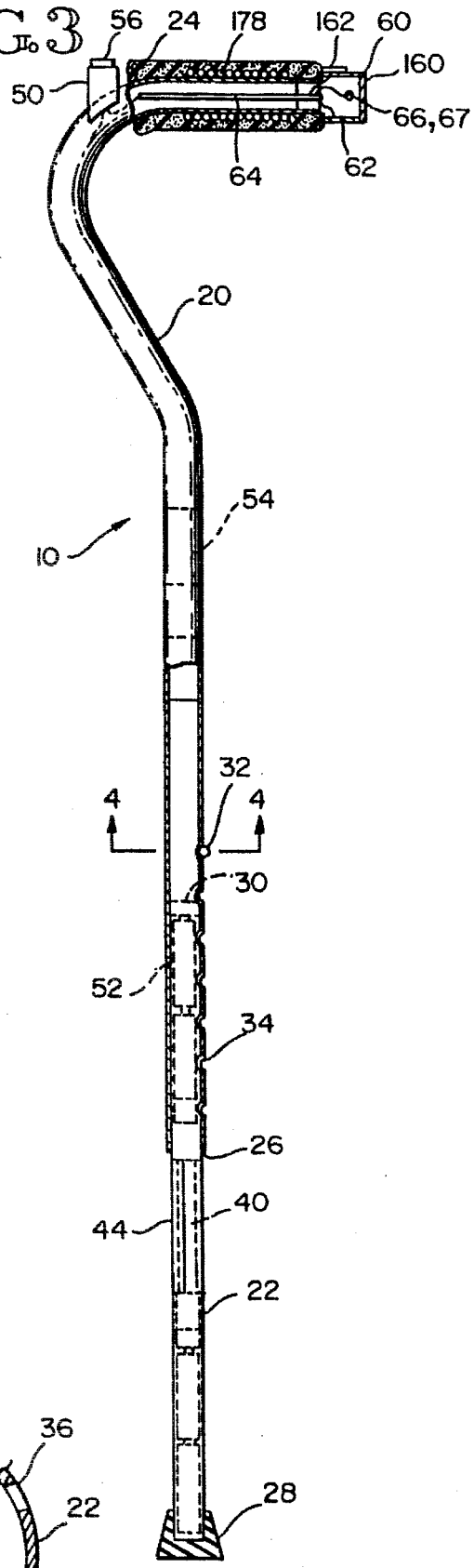
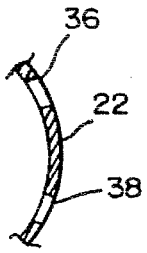
FIG. 4

63
112
53
DC-AC INVERTER
92
NC
Q
$\overline{Q}$
SET
D
CLK
RST
14
7
94
6
4
52
50
V+
ON
OFF
96
8
4
7
6
5
98
100
102
91a
91b
90
78
88
82
2
3
76
84
86
83
72
74
62

113
56
113a
52
V+

SAFETY DEVICE FOR THE PROPRIOCEPTION IMPAIRED

This application is a division of U.S. patent application Ser. No. 07/957,245, filed Oct. 6, 1992, issued as U.S. Pat. No. 5,331,990 on Jul. 26, 1994.

TECHNICAL FIELD

The invention relates to personal safety devices. More specifically, the invention relates to a walking cane employing integral personal safety equipment.

BACKGROUND OF THE INVENTION

Recent improvements in health care and general living standards have produced a population which is significantly older than previous generations. In addition, modern medical technology has enabled individuals who previously would have been seriously disabled, such as individuals suffering a broken hip to maintain a mobile, active lifestyle. New methods of treatment have also enabled those who otherwise would be confined to a wheelchair to walk with the aid of crutches, a cane, braces, etc. As a result, a broad spectrum of personal safety and mobility assisting devices are currently available for use by the aged or infirmed.

Walking canes augmented with various safety devices are a typical class of mobility augmenting products. Canes of this type may include light emitting devices which illuminate a path ahead of the user as in Phillips U.S. Pat. Nos. 4,625,742, Waliciki et al., U.S. Pat. No. 1,427,138 Dyer U.S. Pat. No. 2,173,624, and Parker U.S. Pat. No. 2,597,172.

Another category of personal safety devices include alarms which can be manually activated by the user to attract attention under exigent conditions. U.S. Pat. No. 2,908,901 to Lewis discloses a manually operable audible alarm combined with a flashlight. Divito et al. U.S. Pat. No. 4,583,080 discloses an attachment for a walking cane which includes both an illuminating beam, and an audible alarm.

It has further been recognized that an individual injured by a fall, suffering angina, etc. may not be in a situation where an audible alarm will be heard by someone else. Devices have therefore been developed which broadcast a distress signal to a remote unit connected to a telephone. Upon actuation of the device, the remote unit executes a predetermined program and calls a sequence of telephone numbers with a prerecorded distress message. Linear, a Nortek Company, Carlsbad, Calif. manufactures such a device in the form of a pendant worn by the user. If the user experiences a disabling fall, or otherwise cannot reach the telephone, the user merely depresses a button on the pendant which signals the remote unit to start the automated telephoning sequence. Although the above devices appear in theory to adequately address safety issues concerning mobile yet otherwise infirmed individuals, serious problems are not addressed by these prior art devices.

Particular groups such as the elderly, individuals suffering from nervous system or muscular degenerative conditions often experience a lack of proprioception. Individuals afflicted with this condition lack the necessary internal feedback to determine by feel where their feet are in relation to the ground, steps, etc. These individuals must rely on their principal sense of visual depth perception to determine if their foot is positioned in a proper weight-bearing relationship with a support surface. To prevent an inadvertent fall, these individuals usually walk with a cane or other mobility assisting device such as a walker.

Prior art canes which illuminate the user's path significantly assist individuals suffering from a lack of proprioception. Nevertheless, these individuals invariably experience a disabling fall at one time or another. After a serious fall has occurred, walking canes having audible alarms such as that disclosed in the Divito et al. patent are helpful only if the user is able to reach the cane, trigger the alarm, and only if another individual is nearby to hear the alarm. Furthermore, the remote transmitting pendants such as the above-described Linear device suffer from a surprising drawback. As previously stated, individuals suffering from a lack proprioception are often elderly or otherwise infirmed. When these individuals fall, the results are often disastrous—a broken hip, ribs, head injuries, etc. These individuals may be unconscious, in extreme pain, disoriented, experiencing severe angina, partial paralysis or other conditions which prevent them from being able to manually actuate the transmitting device. As a result, these 1 individuals suffer extreme discomfort, further medical complications-or even death due to the lack of prompt emergency response.

Therefore, a need exists for a device which can provide the safety features heretofore known in the prior art, in addition to automatically summoning aid in the event of a disabling fall, or a fall which results in a disabling condition.

SUMMARY OF THE INVENTION

It is therefore an object of the present invention to provide a device which typically accompanies an ambulatory user and which provides safety features presently available in heretofore known safety devices.

It is another object of the present invention to achieve the above object while automatically summoning assistance in the event of a disabling fall.

It is another object of the present invention to provide an audible signal for the purpose of locating the device should it be dropped in an unlighted location.

It is another object of the present invention to optimize an illumination light pattern for either a right-handed or left-handed user.

It is another object of the present invention to achieve the above objects with a device which also summons help in the event of a disabling infirmity which results in a fall.

It is still another object of the present invention to apply the above objects and advantages in a reliable device which assist the user in preventing a fall if the user suffers from a lack of proprioception.

The invention achieves these and other objects and advantages which will become apparent from the description which follows by providing a walking aid which senses when a user has fallen and automatically summons assistance. The walking aid has circuitry which preferably provides the user with a predetermined time to retrieve the aid in the event that the fall is not disabling. If the walking aid is not returned to a normal, in-use orientation within the predetermined time, only then is help summoned by remote transmission. The walking aid can also provide an illuminated path for the user on demand. Circuitry is included to prevent the illuminating feature from being actuated if the ambient light levels are high to prevent inadvertent drainage of a battery power source.

In its preferred embodiment, the invention is in the form of a cane having a battery powered, light emitting device at its lower end. A light sensor prevents illumination of the light emitting device when the environment is bright. The cane also includes a tipping sensor which detects if the cane has been dropped from a vertical position which presumably indicates that the user has fallen down. An audible alarm will sound if the user does not pick up the cane and return it to a substantially upright position within a first predetermined period. If the cane is not returned to an upright position within this first time period, the alarm continues to sound, and a second, longer time period is initiated. If the cane is not returned to the upright position by the end of this second time period, the cane automatically broadcasts a triggering signal to an automated telephone device which dials a sequence of numbers in ascending order of urgency. For example, the first number dialed may be that of a friend. If that friend does not answer the call, the second number will be dialed which may be that of a relative. If the relative does not answer, the third number dialed may be that of an emergency service, hospital, etc.

BRIEF DESCRIPTION OF THE DRAWINGS

FIG. 2 is an isometric view of the cane.

FIG. 3 is a side elevational, partially cut-away view of the cane.

FIG. 4 is an enlarged, sectional view taken along line 4—4 of FIG. 3.

DETAILED DESCRIPTION OF THE PREFERRED EMBODIMENTS

Figure 1:
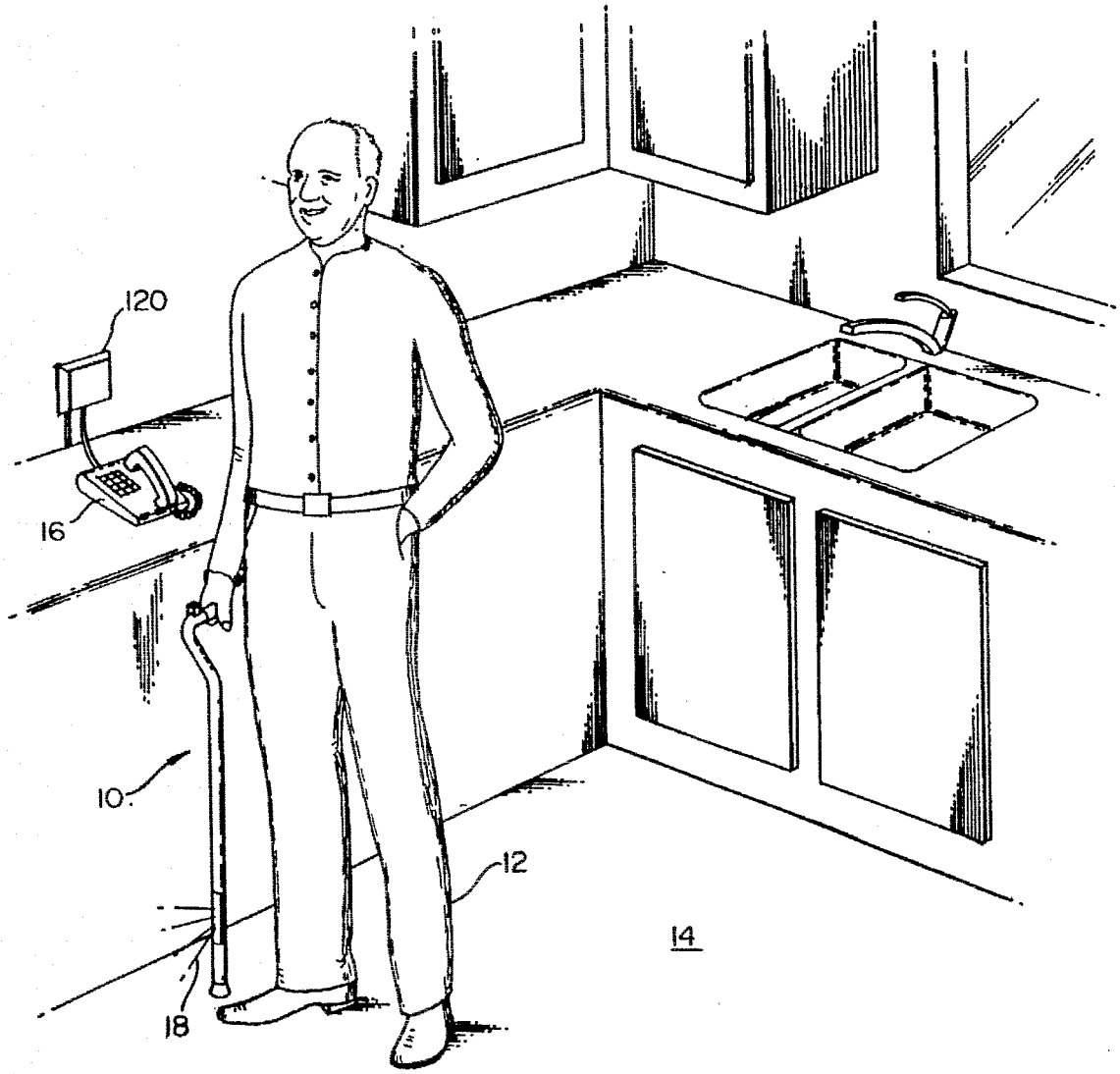
FIG. 1 is an isometric, environmental view of a safety cane employing the features of the present invention.

A safety cane, in accordance with the principles of the invention, is generally indicated at reference numeral 10 in FIGS. 1, 2 and 3. The cane is adapted to provide a user 12 with an enhanced degree of safety, mobility and security in an environment 14 in which the user enjoys an independent lifestyle. The cane provides a direct link with a telephone 16 even when the user is in a location remote therefrom. The cane further provides an illuminated pathway 18 which assists users suffering from a lack of proprioception if the user is ambulatory in a dark room or at night.

As best shown in FIGS. 2 and 3, the cane 10 has an upper, enlarged diameter section 20 which reciprocally receives a lower reduced diameter section 22. The upper section has a handle area 24 at one end, and an open end 26 distal thereto. The lower section 24 has a rubber capped, ground engaging tip 28 at one-end and an open end 30 distal thereto to receive the various components that will be described hereinbelow.

A conventional, spring-loaded button mechanism 32 is connected to the lower section 22 and is adapted for engagement with any one of a series of apertures 34 in the upper section 20. The button mechanism is also engageable with either one of right-hand or left-hand apertures 36, 38 as shown in FIG. 4. The apertures 36, 38 are radially offset by approximately 72° to provide alternate left and right hand adjustment of the upper section 20 with respect to the lower section 22. This configuration optimizes an illumination pattern provided by a conventional four-watt fluorescent lamp 40 located behind a clear acrylic window 44 in the lower section 22. The lamp provides an illuminated pathway directed on center, towards the direction of motion established by the user 12 upon proper adjustment of the button mechanism 32.

The lamp 40 is activated by an alternate action push-button switch 50 conveniently located in the vicinity of the handle 24 for actuation by the user 12 when the ambient light conditions are low. The switch 50 also supports a low battery warning light emitting diode (LED) 56 which illuminates and thereby advises the user 12 if the battery power is below an appropriately predetermined minimum voltage. The fluorescent lamp 40 is powered by four "AA" type batteries 52 of the rechargeable type. 1.2 volt nickel cadmium rechargeable batteries are appropriate for this purpose. As will be described with reference to FIG. 6 herein below, a DC to AC converting circuit 53 is located on a printed circuit board 54 mounted in the upper section 20. This circuit converts the direct current of the batteries to alternating current for operating the fluorescent lamp 40.

To conserve battery power, the cane 10 is provided with an end cap 60 which supports a downwardly directed photosensitive resistor 62. The resistance is inversely proportional to the ambient light level. The resistor is used by a light measuring circuit 63 shown in FIG. 5 which measures the ambient light level and prevents illumination of the lamp 40 (and current drain from the batteries 52) if the ambient light conditions are above a selectable, predetermined level. The light measuring circuit 63 is located on a second printed circuit board 64 is supported by the end cap 60 and resides within the handle area 24. The end cap also supports two terminals 66, 67 which may be connected to a conventional battery charger to recharge the batteries 52. In FIG. 3, terminal 66 is illustrated on the left-hand side of the cane, whereas terminal 67 is located on the right-hand side of the cane and does not appear in the figure but otherwise is a mirror image of terminal 66.

Figure 5:
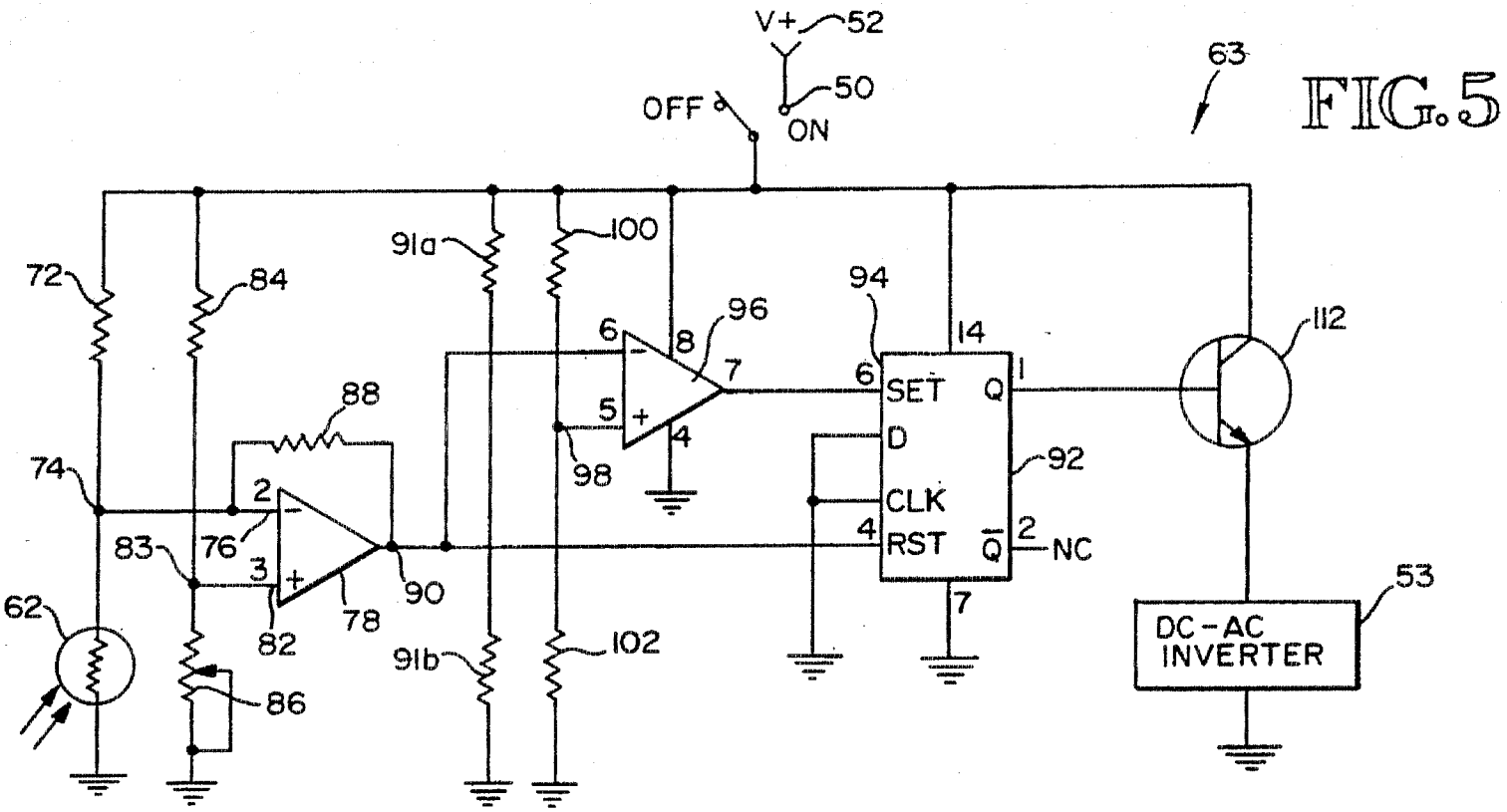
FIG. 5 is a schematic diagram of an ambient light sensing, logic circuit of the present invention.

FIG. 5 is a detailed schematic diagram of the ambient light sensitivity circuit generally indicated at reference numeral 63. The circuit is connected to the batteries 52 by the alternate action push button switch 50. The photo resistor 62 is connected in series to a 47KΩ resistor 72 to the voltage established by the series connection of the batteries 52. The junction 74 between the resistor 72 and photo resistor 62 is connected to an inverting input 76 of a complimentary metal oxide semiconductor operational amplifier 78. The non-inverting input 82 of this operational amplifier is connected to the junction 83 of a voltage divider formed by 100KΩ resistor 84 and a 2KΩ potentiometer 86. The normal voltage of the four, 1.2 volt "AA" cell batteries 52 is approximately 4.8 volts. The potentiometer 86 can therefore be adjusted to provide a reference voltage at the non-inverting input 82 which is representative of a dark room.

As the ambient light conditions surrounding the cane 10 increase (i.e., the room becomes brighter) the resistance of the photosensitive resistor 62 approaches zero. The inverting input 76 is therefore essentially grounded and is less than the reference voltage at the non-inverting input. Due to the negative feedback provided by 1MΩ resistor 88, the output 90 of operational amplifier 78 goes strongly positive. A voltage divider comprising 100KΩ resistor 91*a* and 47KΩ resistor 91*b* establishes a "low" voltage of 1.53 volts (indicative of a dark room) in the event that the output 90 is in a floating condition. Nevertheless, if the room is bright, the output is high. This high output resets a D-type flip-flop 92. The "set" input 94 of the flip-flop 92 is controlled by an operational amplifier 96 configured without feedback so as to behave as a comparator. A reference voltage of 2.4 volts is applied to the noninverting input 98 by a pair of 100KΩ resistors 100, 102. This 2.4 volt input is compared to the strongly positive voltage of the output 90 of operational amplifier 78 forcing the output 104 strongly negative. With the reset of the flip-flop high and the set low, a conventional NPN transistor 112 cannot connect the battery voltage through the switch 50 to a DC/AC convertor 53 to power the lamp 40. As will be described hereinbelow, the lamp can therefore only be illuminated by operation of the switch 50 when the environment 14 is dark.

If the environment is dark, photo resistor 62 has a relatively high resistance which provides a voltage input to the inverting input 76 relatively close to the battery voltage. The non-inverting input 82 has been adjusted to a relatively low voltage causing the output 90 of operational amplifier 78 to go low, preventing the flip-flop 92 from being reset. This low signal is also applied to the inverting input of comparitor 96 which when compared to the 2.4 volts steadily applied to the noninverting input 98, drives the output 104 high. With the flip-flop 92 having a high input on the set terminal 94 and also not having been reset, the base-emitter junction of transistor 112 is forward biased. Therefore, the transistor conducts, the inverter 53 is powered, and the lamp 40 will light when the switch 50 is closed. As previously stated, this feature conserves battery power by preventing inadvertent illumination of the lamp during the day, when the illuminated state may not be noticed by the user 12.

Figure 5A:
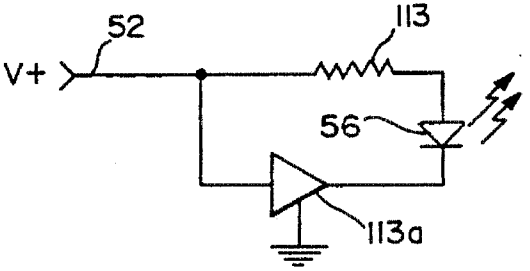
FIG. 5*a* is a circuit diagram of a battery monitoring circuit of the present invention.

FIG. 5*a* shows a battery monitoring circuit 105 which illuminates the LED 56 in FIGS. 2 and 3 when the battery voltage falls below a nominal level. A 1KΩ resistor 113 is included in series with LED 56 in a feedback loop with battery sensor 113*a*. When the battery voltage drops below four volts, the sensor 113*a* provides a ground path for LED 56 thus illuminating the same. A suitable sensor 113*a* is model #5-8054ALB manufactured by Seiko, Japan.

The ambient light sensing circuit 63 and battery monitoring circuit 105 are is located on PC board 64 whereas the inverter circuit 53 is located on PC board 54, both of which are located in the upper section 20 of the cane. The inverter circuit 53 is connected to the batteries 52 and lamp 40 by an elongated cable (not shown).

Figure 6:
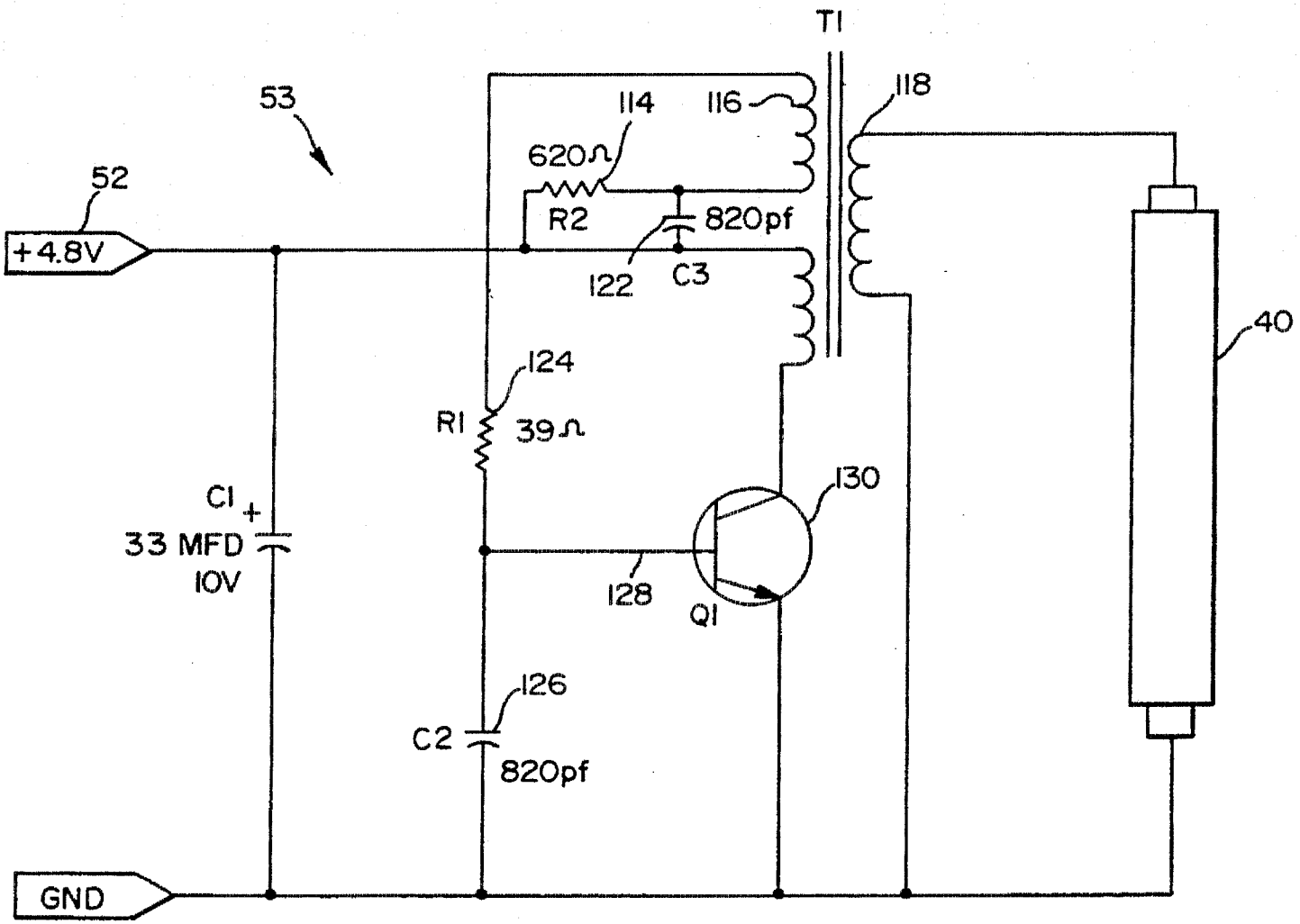
FIG. 6 is a schematic diagram of a DC to AC converter circuit for illuminating a fluorescent lamp of the present invention.

A detailed schematic of the inverter circuit 53 is shown in FIG. 6. A conventional step-up transformer 115 having first and second primary windings 116, 117 inductively transfer voltages to a single secondary winding 118. An appropriate transformer is powder core Model H5A 4307 manufactured by TDK, Inc. The secondary winding has its terminals connected to the fluorescent lamp 40. A parallel resistive-capacitive circuit having a 620Ω resistor 119 and an 820pF capacitor 122 connect the high end of primary windings 116, 117 to the battery voltage 52. The low end of first primary winding 116 is connected in series with a 39Ω resistor 124 and 820 pF capacitor 126 to ground. The junction of the resistor 124 and capacitor 126 is connected to the base of conventional PNP transistor 130. The collector of transistor 130 connects the low end of the second primary winding 117 to ground when the transistor is forward biased. This circuit provides current on secondary winding 118 of approximately 140 Hz with sufficient voltage to cause the lamp 40 to conduct and illuminate. Briefly stated, current first flows through resistor 119, first primary winding 116, resistor 124, and capacitor 126 to ground. As capacitor 126 charges through its very short time constant, the transistor 130 begins to conduct and also establishes a magnetic field in the second primary winding 117. Notice that this field lags in time and is opposed to the field established in first primary winding 116. Eventually, the voltage in secondary winding 118 is sufficiently large to illuminate the lamp 40 causing the magnetic field to discharge starting the cycle over again.

The illumination feature of the safety cane 10 is to assist users having reduced proprioception ability from falling. Nevertheless, in the event that a fall does occur, the cane is provided with a feature which automatically summons help if the user is unable to get up and return the cane to a vertical position. If the fall is disabling (or a disabling condition, i.e., angina, stroke, etc. occurs which precipitates a fall) the cane sounds an audible alarm after a seven-second delay.

If two minutes after a fall the cane has not been returned to a vertical position, the cane transmits a signal to an external receiver 120 shown in FIG. 1 which dials one or more emergency telephone numbers on telephone 16. If the user retrieves the cane before this second approximate two-minute time period has elapsed, the alarm is silenced and the cane does not broadcast a distress signal to the receiver 120.

Figure 7:
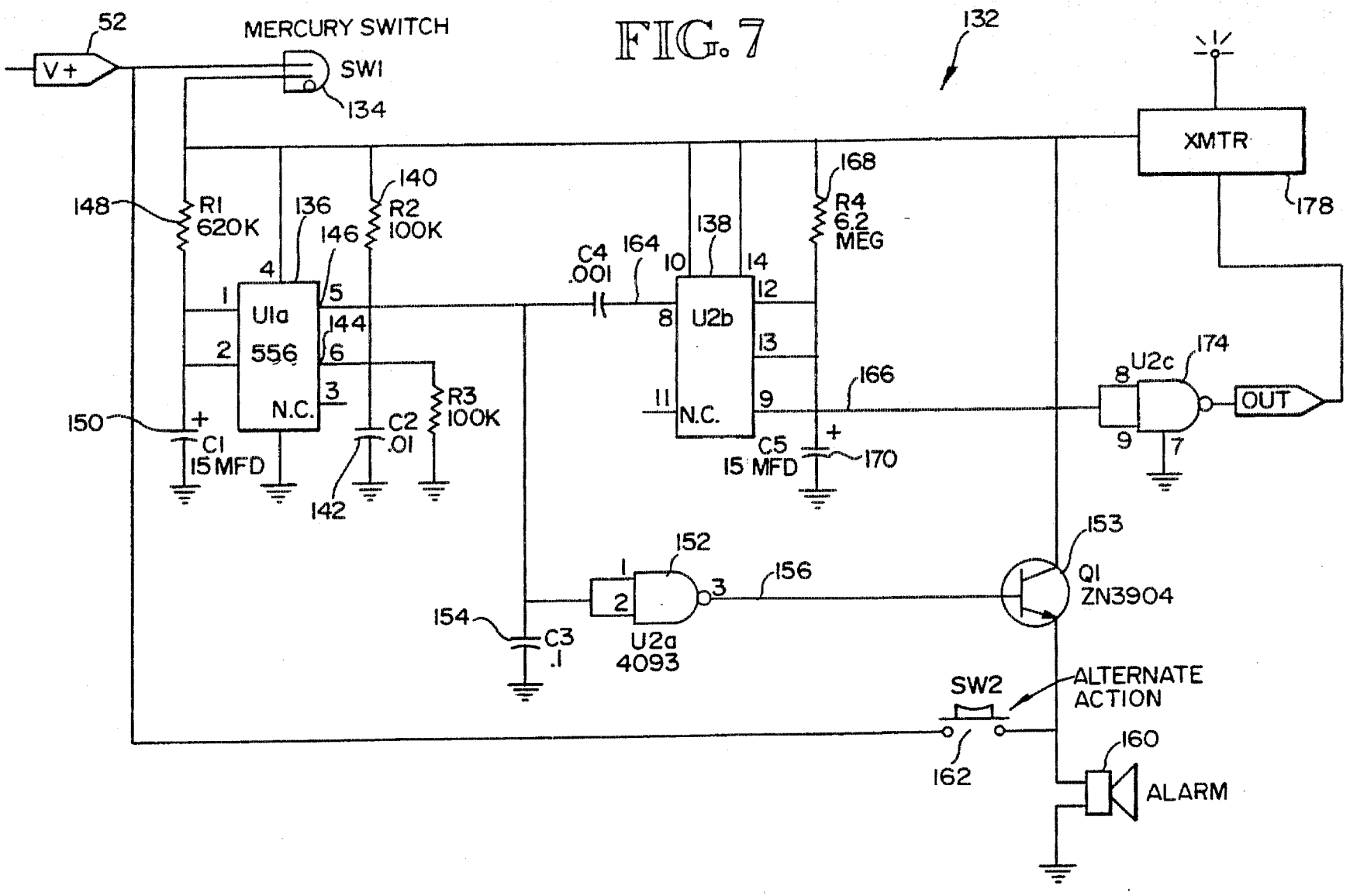
FIG. 7 is a schematic diagram of a time-delay alarm circuit of the present invention.

To this end, the cane employs an inclination detection circuit generally indicated at reference numeral 132 in FIG. 7 which is also placed on first PC board 54. The circuit includes a conventional mercury switch 132 which is connected to the battery voltage 52 and first and second 555 type integrated circuit timers 136, 138. These timers can be implemented in a single model ICM 7556 CMOS twin general purpose timer manufactured by Maxim Integrated Products.

In its normally upright position, the mercury switch 132 is open and does not initiate the timers. However, when the user 12 falls, drops the cane, etc. the mercury switch closes providing a negative trigger through 100KΩ resistor 140 and 0.01F capacitor 142 to the triggering input 144 of the first timer. This causes the output 146 to go high for the duration of the timing period defined by 1.1 times the 9.3 second time constant of the RC circuit defined by 620KΩ resistor 148 and 15μF capacitor 150. This high signal is applied to a NAND gate 152 configured as an inverter. The input to NAND gate (inverter) 152 is normally held high by 0.1F capacitor 154. Thus, when the mercury switch 134 is closed by dropping the cane, the entire circuit 132 is energized with battery voltage and the output 156 of NAND gate 152 stays low for the approximate eight-second duration (i.e., first time period) for the first timer 136. After this first time period expires, the output 146 goes low, driving output 156 high which forward biases the base emitter junction of conventional PNP transistor 158. The transistor therefor conducts the battery voltage to an audible alarm 160 provided in the end cap 60 as shown in FIG. 60. The alarm can also be manually activated by a momentary, push-button switch 162 also located on the end cap 60.

While the alarm 160 continues to sound after the first timer 136 is timed out, the second timer 138 receives a negative pulse transition at its triggering input 164. This causes the output 166 to be driven high for the duration of a second timing period established by the 93-second time constant of 6.2MΩ resistor 168 and 15 μM capacitor 170. This high output is fed through NAND gate 174, having its inputs connected together so as to comprise an output buffer. As long as the cane remains tipped over and the mercury switch 134 closed, the second timer 138 will continue to output a high signal through NAND gate 174 until the second time period has expired. A transmitter 178 powered by the battery voltage 174 is then enabled by the positive going transition of the output 166 when the second time period is completed. A suitable transmitter is Model ET-1B manufactured by Linear, a Nortek Company, Carlsbad, Calif. The transmitter transmits through an antenna 178 (located in the handle area 24 shown in FIG. 3) to an external receiver 120 as shown in FIG. 1. A suitable external receiver is Model D-UR. also manufactured by Linear.

If the cane is returned to the Vertical position before the end of the second time period, mercury switch 134 opens and the transmitter 178 does not receive the initiating signal from the second timer. In addition, the entire circuit is depowered in which case the transmitter 178 is incapable of transmitting. The cane will therefore only initiate a telephone calling sequence if the user is unable to return the cane to a vertical position within approximately two minutes of falling down or dropping the cane. These time periods can be conveniently adjusted by changing the RC time constant of resistor capacitor pair 148, 150 and/or 168, 170 in a manner well known to those of ordinary skill in the art.

It is to be noted that all of the electrical components implemented in printed circuit boards 54, 64 are contained in the upper section 20 of the cane in contrast to the design shown in U.S. Pat. No. 4,625,742 to Phillips which locates a fluorescent lamp transformer in the lower, telescoping section of a cane.

It is to be noted that other embodiments and variations of the invention will be apparent to those of ordinary skill in the art and are contemplated by the inventors. The invention should therefore not be limited by the above disclosure but determined in scope by the claims which follow.

We claim:

1. A method for detecting a disabling condition, comprising the following steps:

providing a portable walking aid device which is carried by a user in an upright position;

monitoring the position of the device;

detecting deviation of the device from the upright position for a predetermined first time period;

triggering a first alarm mechanism if the device is not returned to the upright position before the first predetermined time period expires detecting continued deviation of the device for the upright position for a predetermined second time period measured from the first time period; and, triggering a second alarm mechanism if the device is not returned to the upright position before the second predetermined time period expires.

2. The method of claim 1 wherein the second alarm triggering step incorporates the step of remotely dialing a telephone.

3. The method of claim 2 wherein the remote telephone dialing step is performed by a radio signal.

* * * * *